US005634359A

United States Patent [19]

Huebschen

[11] Patent Number: 5,634,359

[45] Date of Patent: Jun. 3, 1997

[54] REMOVABLE CORE LOCK WITH LATCH ALIGNMENT AND LIMITED LATCH ROTATION

[75] Inventor: David A. Huebschen, Kenosha, Wis.

[73] Assignee: Snap-on Technologies, Inc., Crystal Lake, Ill.

[21] Appl. No.: 573,748

[22] Filed: Dec. 18, 1995

Related U.S. Application Data

[63] Continuation of Ser. No. 222,909, Apr. 5, 1994, abandoned.

[51] Int. Cl.[6] ..... E05B 9/10

[52] U.S. Cl. ..... 70/379 R; 70/451; 70/367; 70/369; 70/370

[58] Field of Search ..... 70/370, 371, 379 R, 70/379 A, 380, 339, 337, 451, 369

[56] References Cited

U.S. PATENT DOCUMENTS

| | | | |
|---|---|---|---|
| 1,832,108 | 11/1931 | Falk | 70/380 |
| 1,941,555 | 1/1934 | Jacobi . | |
| 1,969,010 | 8/1934 | Jacobi . | |
| 1,979,938 | 11/1934 | Jacobi . | |
| 2,255,402 | 9/1941 | Vile | 70/380 |
| 3,336,774 | 8/1967 | Gray et al. | 70/379 R |
| 4,099,397 | 7/1978 | Dauenbaugh | 70/371 |
| 4,398,405 | 8/1983 | Patriquin . | |
| 4,630,457 | 12/1986 | Kincaid et al. . | |
| 4,672,829 | 6/1987 | Gater et al. . | |
| 4,712,400 | 12/1987 | Steinbach . | |
| 4,715,201 | 12/1987 | Craig . | |
| 4,912,953 | 4/1990 | Wobig . | |
| 4,914,932 | 4/1990 | Walla | 70/371 |
| 4,964,494 | 10/1990 | Eisermann . | |
| 4,976,123 | 12/1990 | Ceron et al. . | |
| 5,101,649 | 4/1992 | Duval . | |
| 5,109,685 | 5/1992 | Westwinkel . | |
| 5,119,654 | 6/1992 | Ceron et al. . | |
| 5,295,377 | 3/1994 | Moricz et al. | 70/370 |
| 5,413,392 | 5/1995 | Schlack et al. | 70/379 R |
| 5,431,034 | 7/1995 | Fann et al. | 70/369 |

FOREIGN PATENT DOCUMENTS

| | | | |
|---|---|---|---|
| 1125807 | 3/1962 | Germany | 70/379 R |
| 3603655 | 10/1986 | Germany . | |
| 8915331 | 2/1989 | Germany . | |
| 4009752 | 10/1991 | Germany | 70/370 |
| 2123474 | 2/1984 | Japan | 70/371 |
| 4024378 | 1/1992 | Japan | 70/379 R |
| 2227787 | 8/1990 | United Kingdom | 70/370 |

*Primary Examiner*—Darnell M. Boucher
*Attorney, Agent, or Firm*—Emrich & Dithmar

[57] ABSTRACT

A lock mechanism has a cylindrical housing with an axial bore therethrough, and a key-controlled core rotatable within the bore between locked and unlocked conditions and removable from and installable in the bore in the unlocked condition. The core has a plug at its rear end which is mateably engageable in a socket on the front face of a shifter, for rotating the shifter within the bore in response to rotation of the core, and thereby operating a latch member coupled to the shifter. A radial tab on the housing is receivable in an arcuate groove formed in the outer surface of the shifter for limiting rotation of the shifter to facilitate retention of the shifter in the single rotational orientation upon removal of the core from the housing. An O-ring on the shifter frictionally inhibits rotation thereof.

14 Claims, 1 Drawing Sheet

REMOVABLE CORE LOCK WITH LATCH ALIGNMENT AND LIMITED LATCH ROTATION

This is a continuation of application Ser. No. 222,909, filed Apr. 5, 1994, now abandoned.

BACKGROUND OF THE INVENTION

1. Field of the Invention

This invention relates to locks having key-controlled removable and installable cores and, more particularly, to such locks in which the core must be rotated to a specific position before the removal or installation can be effected.

2. Description of the Prior Art

The use of cylinder locks in connection with various pieces of equipment, such as cabinet drawers and the like, is well known. Various forms of such locks have been constructed for diverse applications, the specific configuration of any particular lock being a function of the particular application. In one such configuration, typically used for locking cabinet drawers and the like, the lock controls a latch member or cam which is engageable with a keeper for locking the drawer. Typically, the latch member or cam is engaged with a shifter which is rotatable within the rear end of the cylindrical housing of the lock and is, in turn, engageable with a key-operated core rotatably disposed in the forward end of the housing. Absent the key, combinating tumblers in the core, which may be disks or pins, are biased into longitudinal grooves or splines in the housing to prevent rotation. When the combinating tumblers read a properly bitted key inserted in a keyway in the core, they are retracted within the core to accommodate rotation of the core between locked and unlocked positions. Each groove may be paired with a companion, diametrically opposed groove, to allow the tumblers to shift about as the key is inserted and withdrawn.

It is often necessary to replace the core. To this end, various constructions of removable lock cores have been developed, wherein the core is usually removable by means of a special release or control key which is intended to operate a special retaining tumbler once the lock core is manipulated into a certain release position by the standard key. Exemplary locks of this type are disclosed, for example, in U.S. Pat. Nos. 5,101,649 and 5,119,654, in each of which locks the core is removable only when disposed in its unlocked position. When such a lock is used in an application utilizing a rotatable latch cam and shifter, the core decouples from the shifter as a result of removal from the housing. While the core can be removed and reinstalled in only a single rotational position relative to the housing, once it is removed the shifter might accidentally be rotated so that, upon reinstallation of a new core, the shifter is no longer in a proper rotational orientation relative to the core. Thus, when the core is rotated to its locked position, the latch cam may not actually be in engagement with the keeper.

SUMMARY OF THE INVENTION

It is a general object of the invention to provide an improved removable-core lock mechanism, which avoids the disadvantages of prior lock mechanisms while affording additional structural and operating advantages.

An important feature of the invention is the provision of a lock mechanism of the type set forth, which includes a latch member shifter which is engageable with the removable core in only a single relative rotational orientation thereof.

Yet another feature of the invention is the provision of a lock mechanism of the type set forth, which inhibits migration of the shifter from the single rotational orientation upon removal of the core.

Still another feature of the invention is the provision of a lock mechanism of the type set forth, which effectively prevents rotation of the shifter beyond positions corresponding to the locked and unlocked conditions of the core.

These and other features of the invention are attained by providing a lock mechanism comprising: a generally cylindrical housing having a bore extending axially therethrough, a key-controlled core rotatable within the bore between locked and unlocked conditions and removable from the bore, a latch shifter adapted to be coupled to the core for rotation therewith within the bore and adapted to be coupled to an associated latch member, first and second coupling structures respectively on the core and the shifter and mateably engageable with each other in only a single rotational orientation thereof relative to each other for rotating the shifter in response to rotation of the core in the bore, and stop structures respectively formed on the housing and the shifter, one of the stop structures including first and second stop surfaces respectively engageable with the other of the stop structures in the locked and unlocked conditions of the core for limiting rotation of the shifter.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figures 1, 2, 3, 4, 5, 6, 7, 8, 9, 10, 11, 12, 13, 14:
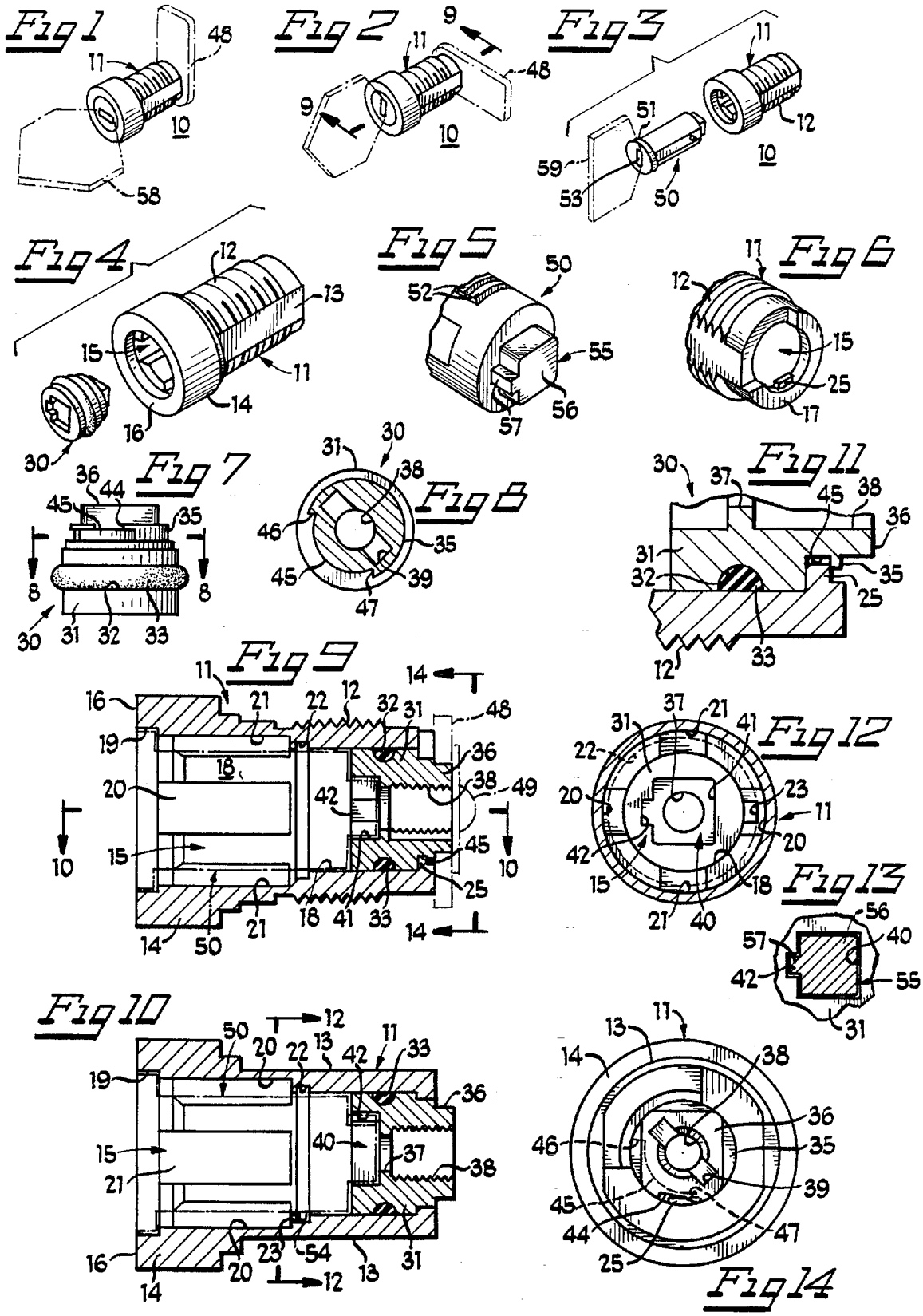
FIG. 1 is a perspective view of a lock in accordance with the present invention illustrated in a locked condition, with a latch member and standard key illustrated in phantom.
FIG. 2 is a view similar to FIG. 1, illustrating the lock in an unlocked position.
FIG. 3 is a partially exploded perspective view of the lock of FIG. 2, illustrating the core of the lock removed with a control key.
FIG. 4 is an enlarged, perspective, exploded view of the cylindrical housing of the lock of FIG. 3.
FIG. 5 is an enlarged, fragmentary, rear perspective view of the core of the lock of FIG. 3.
FIG. 6 is an enlarged, fragmentary, rear perspective view of the cylindrical housing of the lock of FIG. 3.
FIG. 7 is an enlarged top plan view of the latch shifter of the lock of FIG. 4.
FIG. 8 is a view in vertical section taken along the line 8—8 in FIG. 7.
FIG. 9 is an enlarged view in vertical section taken along the line 9—9 in FIG. 2, with the core illustrated in phantom.
FIG. 10 is a view in horizontal section taken along the line 10—10 in FIG. 9, with the latch member removed.
FIG. 11 is an enlarged, fragmentary, sectional view of the rear end of the lock of FIG. 9, illustrating the shifter rotation stop mechanism.
FIG. 12 is a view in vertical section taken along the line 12—12 in FIG. 10.
FIG. 13 is a fragmentary, sectional view illustrating the inter-engagement of the core and the shifter of the lock of FIGS. 1–4.
FIG. 14 is a rear end elevational view of the lock of FIG. 9, taken generally along the line 14—14 therein, with the latch member removed.

Referring to FIGS. 1–4 and 6, there is illustrated a removable-core lock, generally designated by the numeral 10, constructed in accordance with and embodying the features of the present invention. The lock 10 includes a cylindrical housing 11 having an externally threaded body 12 with diametrically opposed flats 13 (FIGS. 4 and 10), and having an enlarged-diameter collar 14 at the forward end thereof. A cylindrical bore 15 extends axially through the cylindrical housing 11 from a front end 16 to a rear end 17 thereof. Referring also to FIGS. 9, 10 and 12, the bore 15 has a substantially cylindrical inner surface 18 with an enlarged-diameter counterbore 19 at the forward end thereof. Formed in the inner surface 18 and extending longitudinally thereof, from the counterbore 19 approximately half the length of the cylindrical housing 11, are a pair of diametrically opposed grooves or splines 20, and a pair of diametrically opposed grooves or splines 21 which are, respectively, spaced substantially 90° from the grooves 20. Also formed in the inner surface 18 a slight distance rearwardly of the rear ends of the grooves 20 and 21 is an annular groove 22. A notch 23 at the rear end of one of the grooves 20 provides communication between that groove 20 and the annular groove 22 (FIGS. 10 and 12). A stop finger 25, longitudinally aligned with the bottom one of the grooves 21, as illustrated in FIG. 9, projects radially into the bore 15 at the rear end of the cylindrical housing 11 (see FIGS. 6, 11 and 14).

Referring in particular to FIGS. 4 and 7–14, a latch shifter 30 is rotatably disposed in the bore 15 at the rear end of the cylindrical housing 11. The shifter 30 has a cylindrical body 31 with a circumferential groove 32 formed in the outer surface thereof in which is disposed an O-ring 33. The outer surface of the cylindrical body 31 has a reduced-diameter portion 35 adjacent to the rear end thereof, from which there extends axially rearwardly a projection 36, which is substantially square in transverse cross section. The cylindrical body 31 has an axial bore 37 therethrough, having an internally threaded portion 38 at the rear end thereof. Also formed in the rear end of the body 31 is a generally rectangular slot 39 which diametrically intersects the threaded bore portion 38. The forward end of the bore 37 is enlarged to define a coupling socket 40, which has a central region 41 substantially square in transverse cross section and a rectangular lobe 42 which projects laterally from one side of the central region 41, as is best illustrated in FIG. 12. The reduced-diameter portion 35 of the body 31 has an arcuate groove 45 formed therein, which has a circumferential extent of approximately 90° and defines radial stop shoulders 46 and 47 at its opposite ends (see FIGS. 7, 8, 11 and 14). The rear end of the reduced diameter portion 35 has a notch 44 therein (FIGS. 7 and 14) which communicates with the groove 45. A latch cam 48 (FIGS. 1, 2 and 9) may be fixedly secured to the rear end of the shifter 30, as by a screw 49 threadedly engaged in the threaded bore portion 38. The latch cam 48 may have a rectangular opening therethrough which fits over the rectangular projection 36 on the shifter 30 to prevent rotation of the latch cam 48 relative to the shifter 30.

Referring in particular to FIGS. 3, 5 and 10, the lock 10 also includes a cylindrical core 50 which is removably receivable in the forward end of the bore 15. The core 50 has an enlarged-diameter, radially outwardly extending flange 51 at the forward end thereof dimensioned to fit in the counterbore 19 of the bore 15. The core 50 has a plurality of tumblers 52 disposed in diametrical slots in the core 50 in a known manner. The tumblers 52, two of which are illustrated in FIG. 5, preferably include a plurality of combinating tumblers to control locking and unlocking of the lock and a retaining tumbler to control removal of the core 50 from the housing 11. The combinating tumblers are dimensioned and arranged to be receivable in the longitudinal splines or grooves 20 and 21 in the cylindrical housing 10, while the retaining tumbler 52 is positioned and dimensioned so as to be receivable in the annular groove 22. Formed axially through the core 50 is a key slot 53 which receives a standard key 58 (FIG. 1) having bittings which are read by the combinating tumblers 52 for retracting the tumblers inside the circumference of the core 50 to permit rotation of the core 50 between its locked and unlocked positions, again all in a known manner. In the preferred embodiment, the locked and unlocked positions are spaced 90° apart, as can be seen in FIGS. 1 and 2. The core 50 also has a retaining lug 54 (FIG. 10) which projects radially outwardly therefrom into the annular groove 22.

In order to remove the core 50 from the housing 11, both the retaining tumbler 52 and the retaining lug 54 must be disengaged from the annular groove 22. The standard key 58 is not long enough to reach the retaining tumbler 52. Thus, for removal of the core 50, a control key 59 is used which is dimensioned to reach the retaining tumbler and retract it into the core 50. However, in the preferred embodiment, the core 50 can be removed only in its unlocked position, in which position the retaining lug 54 aligns with the notch 23 to permit its release from the annular groove 22. Preferably, the control key 59 does not include the standard bittings, so that it cannot be used to rotate the core 50 between its locked and unlocked positions.

Referring in particular to FIGS. 5 and 13, the core 50 includes a coupling plug 55 which projects axially from the rear end thereof and is shaped and dimensioned for mating engagement in the coupling socket 40 of the shifter 30. More specifically, the plug 55 has a central portion 56, which is substantially square in transverse cross section and dimensioned for mating engagement in the central region 41 of the coupling socket 40, and a lug 57 which projects laterally from one side of the central portion 56 and is disposed for mating engagement in the lobe 42 of the coupling socket 40.

It is a significant aspect, of the invention that, because of the lobed arrangement of the coupling socket 40 and the coupling plug 55, the core 50 can be engaged with the shifter 30 only in one relative rotational orientation thereof. Also, as was explained above, because of the retaining lug 54 on the core 50, the core 50 can be removed from and inserted in the housing 11 in only the unlocked position. This will ensure that, when a new core 50 is installed, the latch cam 48 will also be in the unlocked position. Otherwise, it will not be possible to fully insert the core 50 in the housing 11. It will further be appreciated that the frictional engagement of the shifter O-ring 33 with the inner surface 18 of the cylindrical housing 11 inhibits free rotation of the shifter 30 from the unlocked position once the core 50 is removed. Furthermore, the engagement of the stop finger 25 of the housing 11 in the arcuate groove 45 of the shifter 30, and specifically with the stop shoulders 46 and 47, prevents rotational movement of the shifter 30 beyond the locked and unlocked positions.

Also, the groove 45 captures the stop finger 25 to prevent axial movement of the shifter 30 except when the stop finger 25 is aligned with the notch 44, which preferably occurs between the locked and unlocked positions. This permits assembly of the shifter 30 in the housing 11. In the event that the shifter 30 should somehow be rotated slightly from the unlocked position after removal of the core 50, an appropriately-sized square drive tool can be inserted in the coupling socket 40 to rotate the shifter 30 back to the unlocked position to permit reinstallation of the core 50.

In the illustrated embodiment, the core 50 carries a male member (55), while the shifter 30 carries a female socket 40, for inter-engagement of the core 50 and the shifter 30. However, it will be appreciated that a reverse arrangement could be utilized. Similarly, while inter-engagement between the shifter 30 and the housing 11 is effected by a male member (25) formed on the housing 11 and a female groove 45 formed on the shifter 30, it will be appreciated that a reverse arrangement could be utilized.

From the foregoing, it can be seen that there has been provided an improved removable-core lock which includes alignment structure to ensure that the core and the shifter can be inter-engaged in only a single relative rotational orientation, and further including means to inhibit and limit free movement of the shifter from that orientation when the core is removed.

I claim:

1. A lock mechanism comprising: a generally cylindrical housing having a bore extending axially therethrough, a key-controlled core rotatable within said bore between locked and unlocked conditions and removable from said bore, a latch shifter rotatable within said bore and adapted to be coupled to an associated latch member, and first and second coupling structures respectively on said core and said shifter and shaped and dimensioned for mating engagement with each other in only a single rotational orientation thereof relative to each other for rotating said shifter in response to rotation of said core in said bore, one of said coupling structures including a socket having a square central region and a lobe extending laterally from said central region, the other of said coupling structures including a plug having a square central portion and a lug extending laterally from said central portion and adapted to be mateably received in said lobe only when said central portion is disposed in said central region in said single rotational orientation.

2. The lock mechanism of claim 1, wherein said socket is formed on said shifter and said plug is formed on said core.

3. The lock mechanism of claim 1, and further comprising retaining structures respectively on said housing and said core accommodating removal of said core from said bore in only the unlocked condition.

4. A lock mechanism comprising: a generally cylindrical housing having a bore extending axially therethrough, a key-controlled core rotatable within said bore between locked and unlocked conditions and removable from said bore, a latch shifter adapted to be coupled to said core for rotation therewith within said bore and adapted to be coupled to an associated latch member, said shifter having an outer cylindrical surface, a friction member between said cylindrical surface of said shifter and said cylindrical housing and frictionally engageable with each for inhibiting rotation of said shifter when said core is removed from said bore, and stop structures respectively formed on said housing and said shifter, one of said stop structures including first and second stop surfaces respectively engageable with the other of said stop structures in the locked and unlocked conditions of said core for limiting rotation of said shifter.

5. The lock mechanism of claim 4, wherein said one of said stop structures is formed on said shifter.

6. The lock mechanism of claim 4, wherein said locked and unlocked conditions are spaced apart by substantially 90°.

7. The lock mechanism of claim 4, wherein said one of said stop structures includes a cylindrical surface and an arcuate groove formed in said cylindrical surface coaxially therewith and defining said first and second stop surfaces.

8. The lock mechanism of claim 7, wherein said other of said stop structures includes a radially extending tab receivable in said arcuate groove.

9. A lock mechanism comprising: a generally cylindrical housing having a bore extending axially therethrough, a key-controlled core rotatable within said bore between locked and unlocked conditions and removable from said bore, a latch shifter adapted to be coupled to said core for rotation therewith within said bore and adapted to be coupled to an associated latch member, first and second coupling structures respectively on said core and said shifter and shaped and dimensioned for mating engagement with each other in only a single rotational orientation thereof relative to each other for rotating said shifter in response to rotation of said core in said bore, and stop structures respectively formed on said housing and said shifter, one of said stop structures including a cylindrical surface and an arcuate groove formed in said cylindrical surface coaxially therewith and defining first and second stop surfaces, the other of said stop structures including a radially extending tab receivable in said arcuate groove and engageable with said first and second stop surfaces respectively in the locked and unlocked conditions of said core for limiting rotation of said shifter, and further including a notch in said one stop structure communicating with said arcuate groove to accommodate passage of said tab therethrough in only a predetermined rotational position of said shifter thereby to permit axial movement of said shifter relative to said housing.

10. The lock mechanism of claim 9, wherein one of said coupling structures includes a socket having a predetermined shape and the other of said coupling structures includes a plug adapted to be mateably received in said socket.

11. The lock mechanism of claim 9, wherein said socket is formed on said shifter and said plug is formed on said core.

12. The lock mechanism of claim 9, wherein said one of said stop structures is formed on said shifter.

13. The lock mechanism of claim 9, and further comprising a friction member between said shifter and said housing inhibiting rotation of said shifter.

14. The lock mechanism of claim 1, and further comprising a friction member between said shifter and said housing inhibiting rotation of said shifter.

* * * * *